US006220940B1

(12) United States Patent
Johnson

(10) Patent No.: US 6,220,940 B1
(45) Date of Patent: Apr. 24, 2001

(54) MICRO-FINISHING APPARATUS

(75) Inventor: James N. Johnson, Youngstown, OH (US)

(73) Assignee: Grinding Equipment & Machinery Co., Inc., Youngstown, OH (US)

( * ) Notice: Subject to any disclaimer, the term of this patent is extended or adjusted under 35 U.S.C. 154(b) by 0 days.

(21) Appl. No.: 09/427,862

(22) Filed: Oct. 27, 1999

(51) Int. Cl.[7] ..... B24B 5/37

(52) U.S. Cl. ..... 451/59; 451/168; 451/49; 451/336

(58) Field of Search ..... 451/59, 168, 49, 451/167, 245, 336, 299, 300, 302

(56) References Cited

U.S. PATENT DOCUMENTS

| | | | | |
|---|---|---|---|---|
| 1,281,366 | * | 10/1918 | Heim | 451/49 |
| 1,932,092 | * | 10/1933 | Hijo | 451/300 |
| 3,271,909 | * | 9/1966 | Rutt et al. | 451/300 |
| 3,732,648 | | 5/1973 | Shaller . | |
| 3,909,986 | * | 10/1975 | Miyazawa et al. | 451/300 |
| 5,437,125 | | 8/1995 | Barton, II . | |
| 5,683,291 | | 11/1997 | Humpert et al. . | |
| 5,695,391 | | 12/1997 | Steinwender . | |
| 5,766,057 | | 6/1998 | Maack . | |
| 5,803,796 | | 9/1998 | Barton, II . | |
| 5,863,239 | | 1/1999 | Barton, II . | |
| 5,913,716 | * | 6/1999 | Mucci et al. | 451/59 |

FOREIGN PATENT DOCUMENTS

| | | | | |
|---|---|---|---|---|
| 0504355 | * | 8/1930 | (DE) | 451/302 |
| 2254643 | * | 5/1974 | (DE) | 451/299 |

* cited by examiner

*Primary Examiner*—Robert A. Rose
(74) *Attorney, Agent, or Firm*—Robert J. Herberger

(57) ABSTRACT

A micro-finishing apparatus for finishing the outer surface of small cylindrical workpieces with repeatability. The apparatus comprises a regulating mechanism rotating and feeding a workpiece against a micro-finishing spool drive mechanism. Planar extents of the regulating mechanism and micro-finishing spool drive mechanism form an opening having a distance that is no greater than the diameter of the workpiece. The workpiece is fed through the opening at an angle by a guide bar. The regulating mechanism rotates the workpiece against the abrasive of the micro-finishing spool drive mechanism and simultaneously feeds it through the apparatus.

14 Claims, 5 Drawing Sheets

MICRO-FINISHING APPARATUS

FIELD OF THE INVENTION

This invention relates to a micro-finishing apparatus capable of providing continuous through-feed. More specifically, this invention is used to place a repeatable micro-finish on cylindrical workpieces having a relatively small diameter.

BACKGROUND OF THE INVENTION

Micro-finishing is a surface finishing process wherein an abrasive is brought to bear against a workpiece having a rough outer surface. By improving the surface finish, less friction will be produced between the workpiece and any contact surface thereby extending the life of the workpiece. Non-metallic products, such as wood, glass, rubber and plastic can also be micro-finished.

How a workpiece is micro-finished depends on its shape and size. Viewing FIGS. 1–4 herein, "centerless" or "center" operations dictate how a workpiece is held in place during the finishing process. Center operations are appropriate when the workpiece is large enough in diameter and length to be supported at each end for rotation, such as with a chuck on a lathe. However, when the diameter or the length of a workpiece is too small to be supported by a lathe, centerless operations may be used by placing the workpiece, for example, between two rotating rollers, as seen in FIGS. 2 and 4.

In addition, a workpiece contacts the abrasive either through "plunge" or "transverse" operations. A workpiece is subject to finishing by plunge operations when the workpiece's length is less than or equal to the width of the available abrasives. The entire length of the workpiece is constantly in contact with the abrasive. Transverse finishing is used when the workpiece is longer than the width of any available abrasives. In which case the abrasive must travel along the longitudinal axis of the rotating workpiece as it micro-finishes.

It is therefore well known in the art that the shape and size of the metal product will determine which one of the various micro-finishing machines would produce the best finish: 1) plunge-center; 2) plunge-centerless; 3) transverse-center; or 4) transverse-centerless.

For purpose of this invention, it is important to expand upon the typical transverse centerless micro-finishing machine known in the art. When cylindrical metal workpieces are micro-finished using the transverse centerless micro-finishing type machine, the workpieces are placed between two rollers as seen in FIG. 4. The rollers are located beneath the abrasive and are offset at an angle for feeding the part through the micro-finishing apparatus. Hence, this process is also often referred to as "through-feed centerless" micro-finishing. The rollers rotate in the same direction very quickly, thereby rotating the part along the abrasive. Problems occur when workpieces are very small, such as those having diameters less than ⅜ of an inch or 8 millimeters. Particularly, transverse centerless cylindrical workpieces are difficult to micro-finish, if not impossible for small parts, because the abrasive cannot reach the small workpiece positioned between the rollers. This is due to the large difference in diameter between the rollers and the workpiece. More specifically, the diameter of the workpiece is so small that the abrasive contacts the rollers and never reaches the workpiece positioned therebetween. Also, conventional methods of holding the workpiece during finishing, such as using a lathe, cannot be used because the workpieces are just too small to be held by the chuck.

Art in the field may also be directed to grinding machines, as opposed to micro-finishing machines. Typical grinding machines are shown in FIGS. 5 and 6. These machines are comprised of a regulating mechanism, an abrasive and a means of supporting the workpiece at a fixed location. However, none of the grinding machines in the art can be used to solve the problem of micro-finishing miniature cylindrical workpieces. Problems exist in traditional grinding processes because of the abrasive used. In traditional grinding processes, the abrasive is a wheel or continuous belt that travels very fast, constantly being reused. As a result, the finish varies as the abrasive wears. Also, the contact surface of the abrasive is short if a plurality of workpieces are continuously fed through typical grinding machines. The preferred apparatus should repeatably produce consistent micro-finishing results to the entire outside surface of very small centerless workpieces.

In summation, there is nothing currently in the art capable of micro-finishing small workpieces. The purpose of this invention is to provide an apparatus that can micro-finish the outer surface of very small cylindrical workpieces with repeatability and consistency.

SUMMARY OF THE INVENTION

The present invention is directed to a micro-finishing apparatus, satisfying the need for finishing small cylindrical workpieces. This is accomplished by feeding the workpiece through two planar surfaces, one surface being a regulating mechanism and the other being a micro-finishing spool drive mechanism. The regulating mechanism rotates the workpiece against the abrasive of the micro-finishing spool drive mechanism and feeds it through the apparatus.

More specifically, this invention comprises a regulating mechanism having a planar contact surface for rotating the workpiece. The micro-finishing drive mechanism advances a roll of non-continuous abrasive belt over a planar grinding work face, which is substantially parallel to and forms an opening with the planar contact surface of the regulating mechanism. The invention also comprises a guide bar that passes through the opening and traverses at an angle between the planar contact surface of the regulating mechanism and the planar grinding work face of the micro-finishing drive mechanism.

Accordingly, it is an object of the present invention to provide a micro-finishing apparatus that is capable of micro-finishing small cylindrical workpieces that cannot be micro-finished on center machines or machines that support a workpiece on rollers.

Another objective of the present invention is to provide a micro-finishing apparatus that provides repeatability in finishing results by always introducing the workpiece to new abrasive.

Still another objective of the present invention is to provide a micro-finishing apparatus that more efficiently utilizes abrasive material by moving the abrasive at a very low rate of speed.

Another objective of the present invention is to provide a micro-finishing apparatus that can adjust to accommodate cylindrical workpieces of various diameters.

Further, another objective of the present invention is to provide a micro-finishing apparatus that has continuous through feed so that a plurality of workpieces can be micro-finished without constant and direct manual intervention.

These and other features, aspects and advantages of the present invention will become better understood with reference to the following description and appended claims.

BRIEF DESCRIPTION OF THE DRAWINGS

The figures listed below have been selected to illustrate a preferred embodiment of the present invention. These figures along with the accompanying description are sufficient for those skilled in the art to practice the invention as claimed. Included are:

PREFERRED EMBODIMENT

Figure 1:
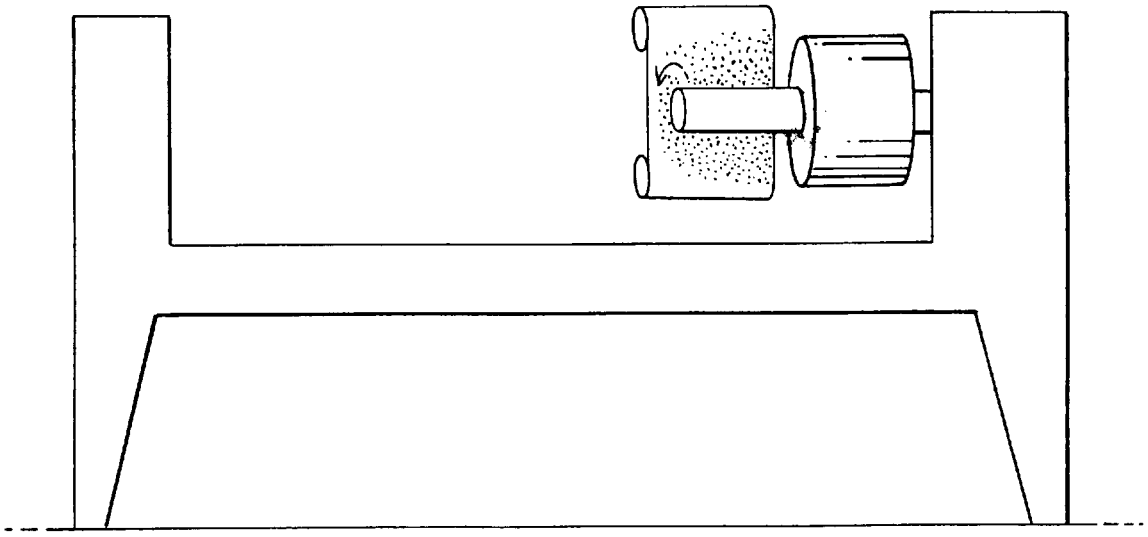
FIG. 1 PRIOR ART
FIG. 1 illustrates a plunge-center micro-finishing machine used in the art.
Figure 2:
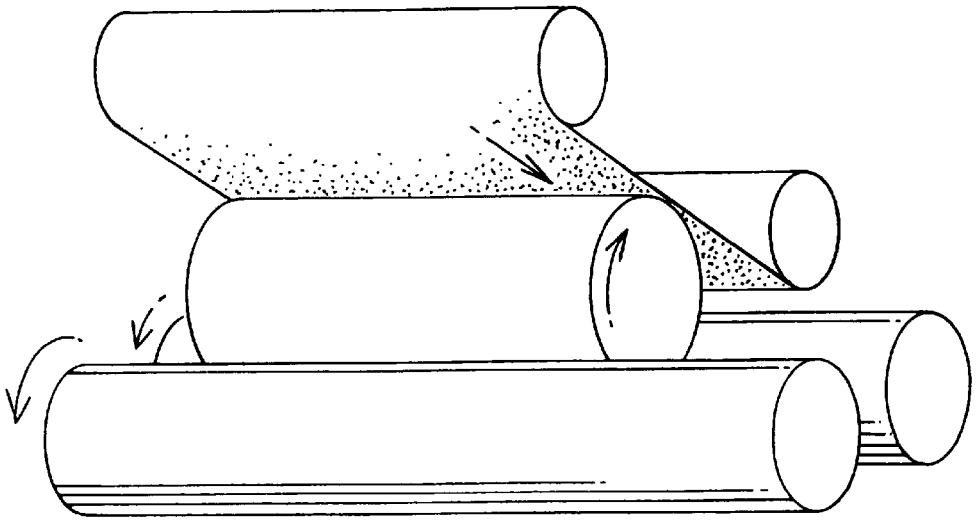
FIG. 2 PRIOR ART
FIG. 2 is a perspective illustration of a plunge-centerless micro-finishing concept used in the art.
Figure 3:
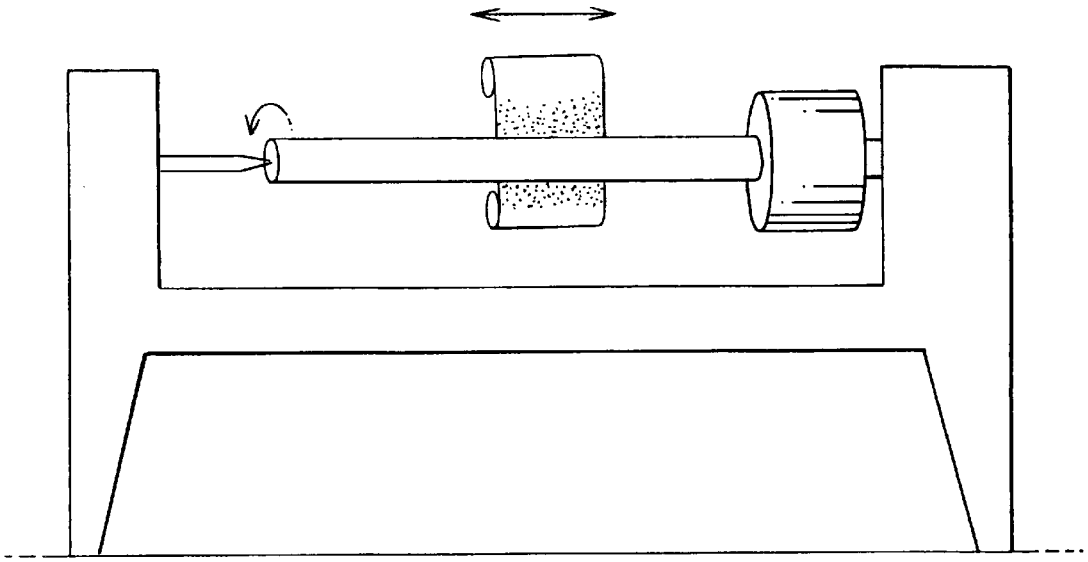
FIG. 3 PRIOR ART
FIG. 3 illustrates a transverse-center micro-finishing machine used in the art.
Figure 4:
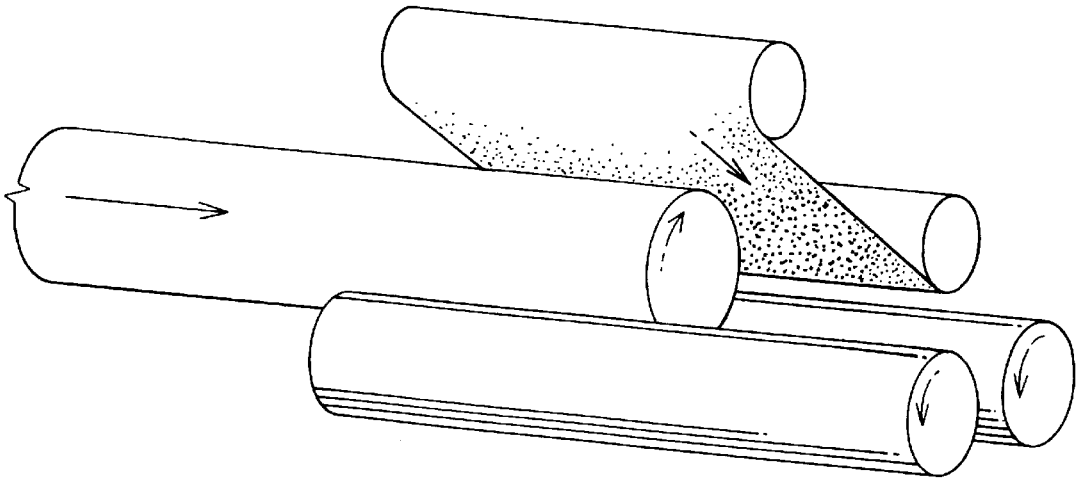
FIG. 4 PRIOR ART
FIG. 4 is a perspective illustration of a transverse-centerless micro-finishing concept used in the art.
Figure 5:
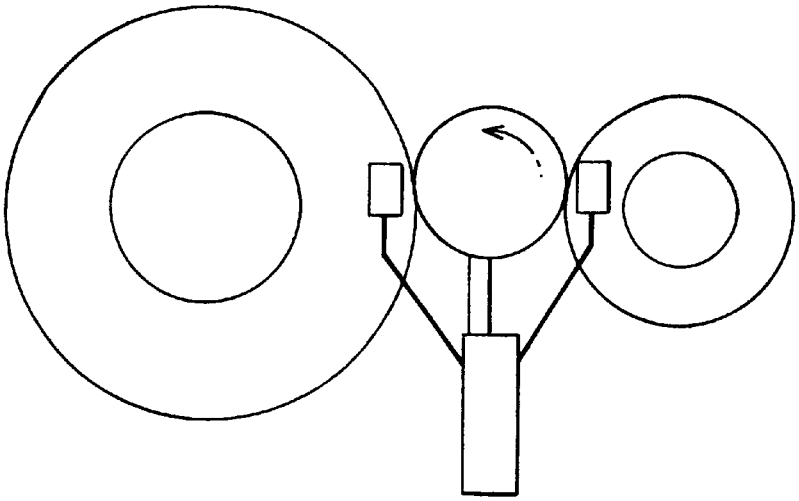
FIG. 5 PRIOR ART
FIG. 5 illustrates an elevational side view of a centerless grinding machine used in the field.
Figure 6:
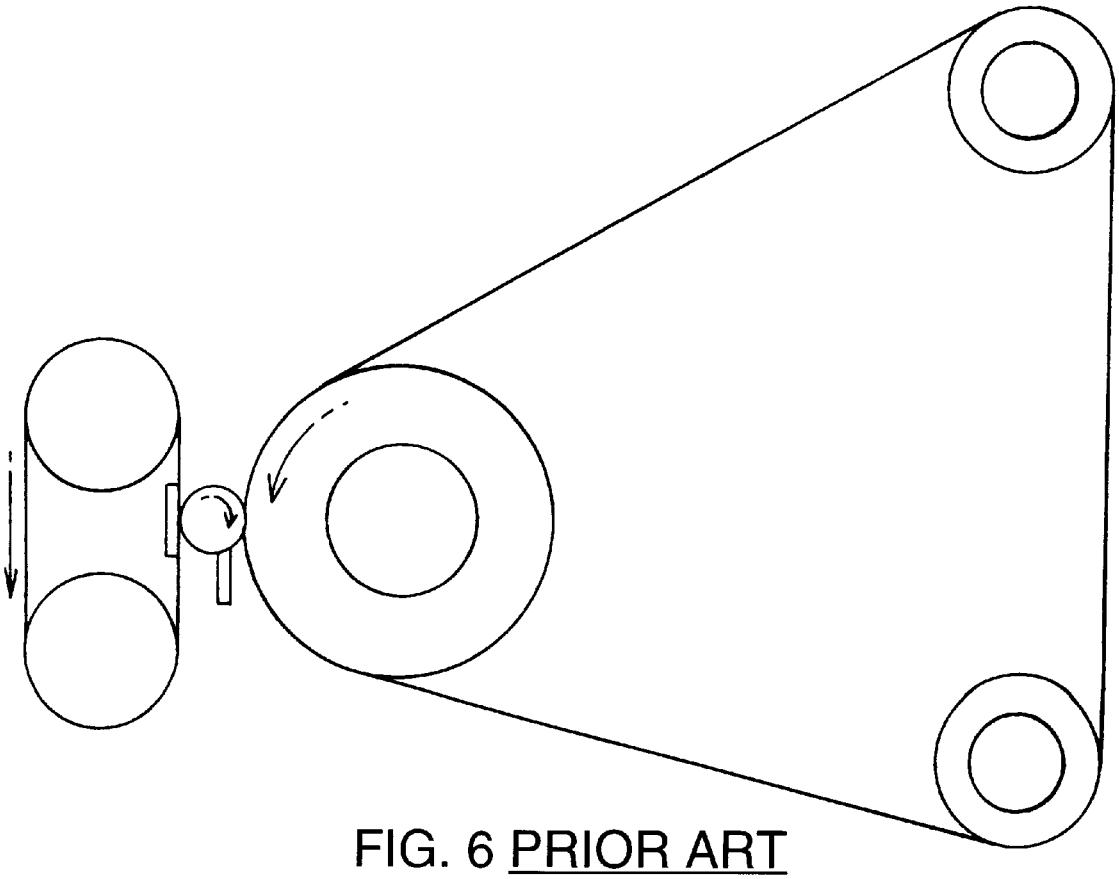
FIG. 6 PRIOR ART
FIG. 6 illustrates an elevational side view of another type of a centerless grinding machine used in the field.
Figure 7:
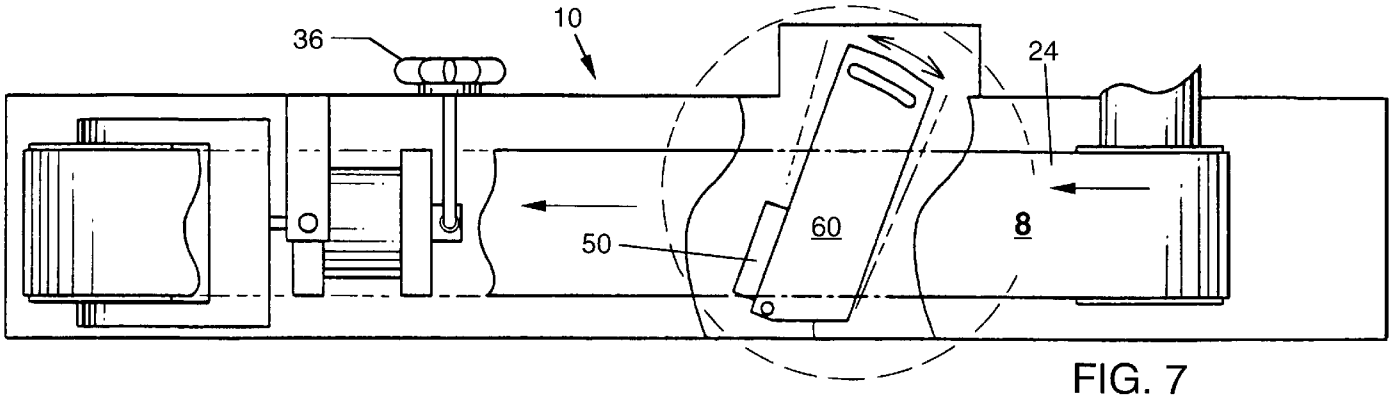
FIG. 7 is a top plan view of the apparatus of the present invention.
Figure 8:
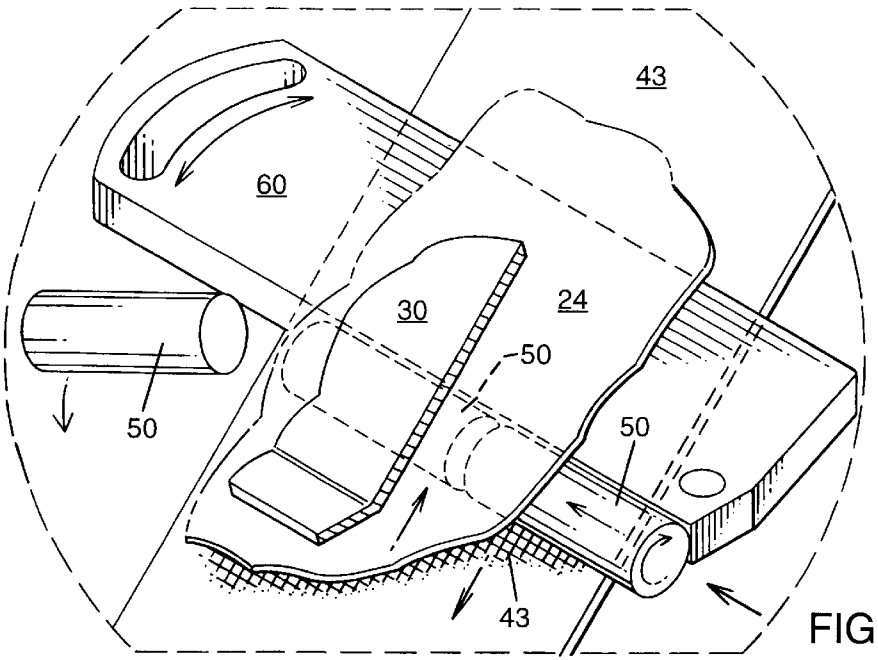
FIG. 8 is an enlarged perspective detail showing the present invention as indicated at dashed circle 8 on FIG. 7.
Figure 9:
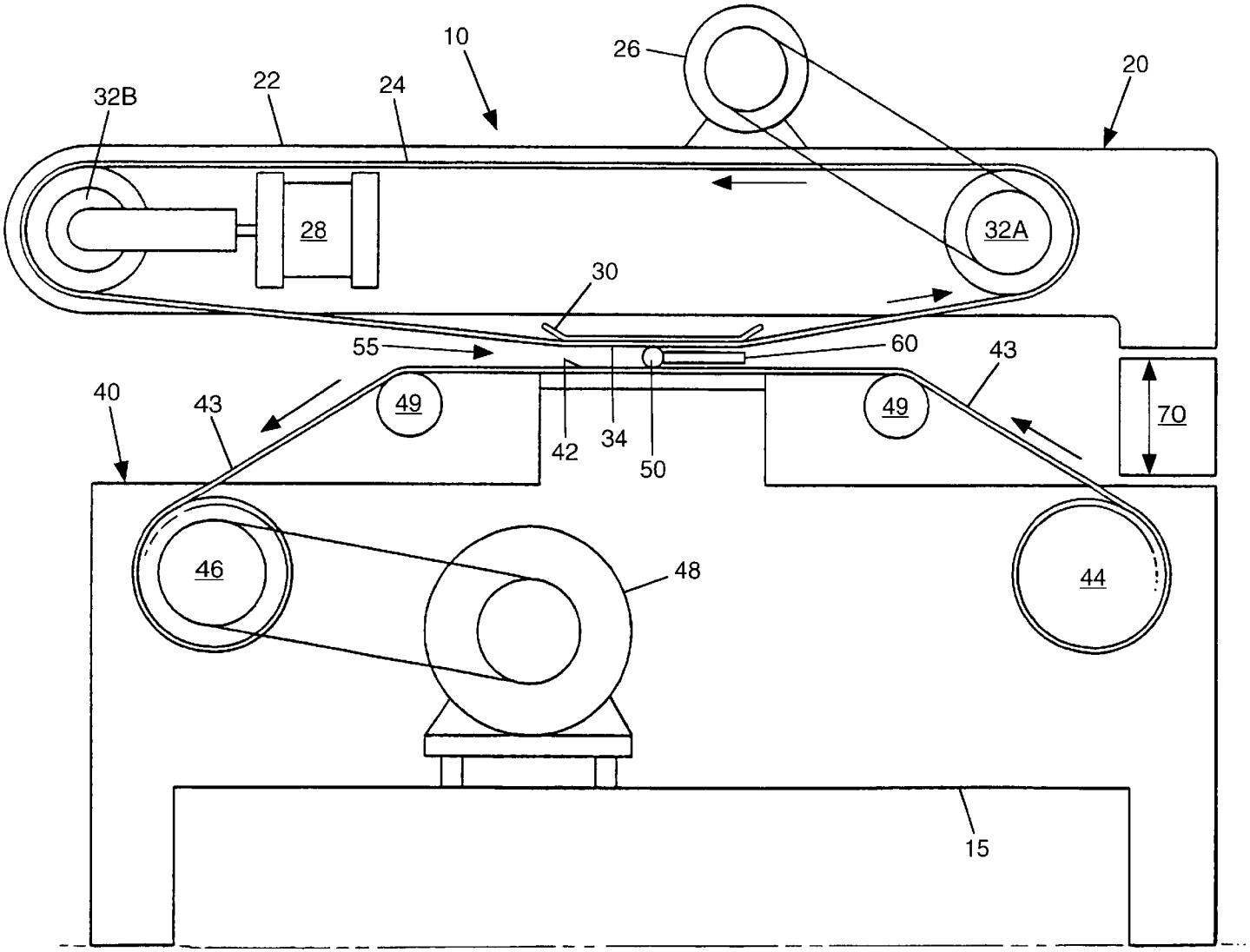
FIG. 9 is an elevational front view of the apparatus of FIG. 7.

Viewing FIGS. 7, 8 and 9, a micro-finishing apparatus 10, comprises a base 15 supporting a regulating mechanism 20, a micro-finishing spool drive mechanism 40 and a guide bar 60. The base 15 supports the micro-finishing spool drive mechanism 40 mounted below the regulating mechanism 20. However, any other feasible orientation could be used. The regulating mechanism 20 has a planar contact surface 34. The micro-finishing spool drive mechanism 40 has a grinding work face 42 being substantially planar and parallel to the planar contact surface 34 of the regulating mechanism 20 forming an opening 55 therebetween. The working width of the work face 42 and contact surface 34 are substantially equal. Their lengths may vary, however, as seen in FIG. 9.

A workpiece 50 is fed through the micro-finishing apparatus 10 lateral to and at an angle with the contact surface 34 and grinding work face 42. As the workpiece is fed through, it is supported by the guide bar 60 while the regulating mechanism 20 rotates the workpiece 50 against the grinding work face 42 of the micro-finishing spool drive mechanism 40. The angled guide bar 60 and regulating mechanism 20, shown in FIGS. 7 and 8, cooperate to continually feed each workpiece 50 through the micro-finishing apparatus 10.

The regulating mechanism 20 further comprises a drive belt housing 22 which acts as a frame for drive belt components 24–36. The drive belt housing 22 supports a drive belt 24, a drive belt motor 26, a drive belt tension device 28, a plurality of drive belt pulleys 32A,32B and a tracking device 36. Via friction, the drive belt 24 provides the force to rotate the workpiece 50 against the grinding work face 42. The speed of the drive belt 24 also determines the through-feed rate of the micro-finishing apparatus 10 as well as the number of times the workpiece 50 rotates while it is passing through the micro-finishing apparatus 10. The drive belt 24 has a high coefficient of friction and should be a non-abrasive material such as cork or rubber so as not to interfere, scratch or otherwise damage the micro-finish of each workpiece, but it is not limited to these materials.

The drive belt motor 26 powers the drive belt 24 through the plurality of drive belt pulleys 32. The drive belt motor 26 is preferably electric, although it may be pneumatic or hydraulic. The drive belt tension device 28 keeps the drive belt 24 taut as it goes around the plurality of drive belt pulleys 32. The tracking device 36 maintains the drive belt 24 laterally in the appropriate position in relation to the grinding work face 42 while the drive belt 24 is rotating as shown in FIG. 7. In another embodiment of the invention, the regulating mechanism 20 further comprises a drive belt platen 30 to provide a flat support for the drive belt 24 so that the height of the opening 55 formed by the drive belt 24 and the grinding work face 42 is substantially uniform. The drive belt platen 30 can be rigidly attached to the regulating mechanism 20, or it can be attached so that it has a spring effect.

As shown in FIG. 9, the micro-finishing spool drive mechanism 40 comprises an abrasive 43, an abrasive supply roll 44 which houses new abrasive 43, an abrasive take-up roll 46 which houses used abrasive 43, an abrasive advance motor 48 and a plurality of working surface pulleys 49. The abrasive advance motor 48 drives the abrasive take-up roll 46 which pulls the abrasive 43 from the abrasive supply roll 44 over the plurality of working surface pulleys 49. The abrasive supply roll 44 may further comprise a tension mechanism (not shown), such as a clutch, for maintaining tension on the abrasive 43. Also, the abrasive advance motor 48 may be a gear motor, but it is not limited thereto. It is preferred that the abrasive 43 move slowly so that the workpiece 50 always contacts new abrasive 43 for repeatability in micro-finishing results. The abrasive 43 should not move too fast, however, so as to waste the abrasive 43 which is generally very expensive because of the type of material used, i.e. diamond fines.

Continuing to view FIG. 9, the opening 55 between the drive belt 24 of the contact surface 34 in the regulating mechanism 20 and abrasive 43 of the working face 42 in the micro-finishing spool drive mechanism 40 has a distance substantially equal to the diameter of the workpiece 50. A vertical adjustment device 70, affixed to the micro-finishing apparatus 10 changes the height of the opening 55 to accommodate different workpiece 50 diameters.

As previously stated, the guide bar 60 passes into the opening at an angle and holds the workpiece 50 in the micro-finishing apparatus 10 during processing. More specifically, the guide bar 60 is located relatively upstream of the forward moving belt 24 so that the workpiece 50 rests against the guide bar 60 during the micro-finishing operation. The angle of the guide bar 60 influences the through-feed rate of the micro-finishing apparatus 10 as well as the number of times the workpiece 50 rotates while it is in the micro-finishing apparatus 10. More specifically, the greater the angle the shorter the residence time. Likewise, the smaller the angle the greater the residence time. Of course, the number of times the workpiece 50 rotates while it is in the micro-finishing apparatus 10 is directly proportional to the residence time.

The micro-finishing apparatus 10 is operated by placing the drive belt 24 into rotation via the drive belt motor 26 and drive belt pulleys 32. The optimum speed of the drive belt 24 is approximately 400 surface feet per minute, although it can be adjusted to accommodate different workpiece materials and abrasive 43. The abrasive 43 is then set into motion by the abrasive advance motor 48 driving the abrasive take-up roll 46. The abrasive advance motor 48 rotates the abrasive take-up roll 46 by pulling the abrasive 43 from the abrasive supply roll 44 and over the planar grinding work face 42 at a rate of approximately ½ inch per minute. To maximize the efficiency of the abrasive material, the abrasive 43 is preferably pulled in the opposite direction as the belt 24, although they can be pulled in the same direction without substantial changes in results. The guide bar 60 is positioned at an angle relative to the driving belt 24, and the cylindrical workpiece 50 is fed through the micro-finishing apparatus 10. The drive belt 24 rotates the cylindrical workpiece 50 along its longitudinal axis against the abrasive 43 of the planar grinding work face 42 as the workpiece 50 is fed in the opening 55 and passes laterally across the abrasive 43 before exiting the micro-finishing apparatus 10.

Although the present invention has been described in considerable detail with reference to certain preferred versions thereof, other versions are possible. Therefore, the spirit and scope of the appended claims should not be limited to the description of the preferred versions contained herein.

What is claimed is:

1. A micro-finishing apparatus for micro-finishing a cylindrical workpiece that has a substantially uniform diameter and a longitudinal axis, the apparatus comprising:

a regulating mechanism having a planar contact surface for rotating the workpiece about said longitudinal axis, the regulating mechanism moving the contact surface in a forward direction at a substantially constant speed;

a micro-finishing drive mechanism for advancing a non-continuous abrasive belt over a planar grinding work face at a speed no greater than two inches per minute which is substantially less than the speed of the contact surface, the abrasive belt having a width, the planar grinding work face being positioned between at least two spools substantially parallel to and forming an opening with the planar contact surface of the regulating mechanism; and a guide bar passing through the opening between the planar contact surface of the regulating mechanism and the planar grinding work face of the micro-finishing drive mechanism, the guide bar being at an angle that traverses upstream relative to the forward moving contact surface of the regulating mechanism so that the workpiece rests against the guide bar as said workpiece traverses the width of the abrasive belt during the micro-finishing operation.

2. The apparatus of claim 1, further comprising an adjustment device for adjusting the size of the opening.

3. The apparatus of claim 1, wherein the regulating mechanism further comprises a drive belt platen supporting the planar contact surface so that the opening between the planar contact surface and the planar grinding work face is substantially uniform.

4. The apparatus of claim 1, wherein the regulating mechanism further comprises a tension device for keeping the planar contact surface taut and a tracking device for maintaining the planar contact surface aligned with the planar grinding work face of the micro-finishing drive mechanism.

5. The apparatus of claim 1, wherein the micro-finishing drive mechanism further comprises an abrasive supply roll and an abrasive take-up roll positioned on opposite sides of the planar grinding work face and advancing at the speed no greater than one inch per minute in a reverse direction relative to the direction of the movement of the contact surface.

6. The apparatus of claim 5, wherein the abrasive supply roll is advanced at the speed of approximately one-half inch per minute by an electric motor.

7. A micro-finishing apparatus for micro-finishing a plurality of cylindrical workpieces that have a substantially uniform diameter and a longitudinal axis, the apparatus comprising:

a regulating mechanism having a belt with a contact surface for rotating each workpiece about said longitudinal axis, the regulating mechanism moving the contact surface in a forward direction at a substantially constant speed;

a non-continuous abrasive having a length and a width;

a micro-finishing drive mechanism for advancing the non-continuous abrasive over a planar grinding work face positioned between at least two spools at a speed no greater than two inches per minute. the abrasive moving in a direction opposite to and substantially slower than the contact surface, the planar grinding work face being substantially parallel to the contact surface of the regulating mechanism thereby forming an opening with the contact surface, the height of the opening being no larger than the diameter of the workpieces; and a guide bar passing through the opening and traversing across the width of the abrasive belt and the contact surface, the guide bar having an angle and being relatively upstream of the forward moving contact surface of the regulating mechanism so that each workpiece rests against the guide bar as each workpiece traverses the width of the abrasive belt across the planar grinding work face during the micro-finishing operation.

8. The apparatus of claim 7, further comprising an adjustment device attached to the regulating mechanism for adjusting the height of the opening.

9. The apparatus of claim 7, wherein the regulating mechanism further comprises a drive belt platen supporting the planar contact surface so that the opening between the planar contact surface and the planar grinding work face is substantially uniform.

10. The apparatus of claim 7, wherein the regulating mechanism further comprises a tension device for keeping the planar contact surface taut and a tracking device for maintaining the planar contact surface aligned with the planar grinding work face of the micro-finishing drive mechanism.

11. The apparatus of claim 7, wherein the two spools are an abrasive supply roll and an abrasive take-up roll which advance at a rate of approximately one-half inch per minute.

12. The apparatus of claim 11, wherein the abrasive supply roll is advanced backward in relation to the forward moving direction of the contact surface of the regulating mechanism by an electric motor.

13. The apparatus of claim 7, wherein one of the spools further comprises a tension mechanism for tracking tension on the non-continuous abrasive.

14. A method for micro-finishing a cylindrical workpiece having uniform diameter and a longitudinal axis, comprising the steps of:

advancing a planar contact surface of a regulating mechanism at a relatively constant speed;

pulling a non-continuous abrasive of a micro-finishing drive mechanism over a planar grinding work face at a speed of approximately one-half inch per minute which is substantially less than the speed of the advancing contact surface, the planar grinding work face being substantially parallel to and forming an opening with the planar contact surface of the regulating mechanism;

adjusting the distance between the regulating mechanism and the micro-finishing drive mechanism so that the size of the opening is no greater than the workpiece diameter; and feeding the workpiece into the opening along a guide bar positioned at an angle relative to the regulating mechanism so that the workpiece is forced against the guide bar by the planar contact surface of the regulating mechanism, the workpiece traverses the opening along said guide bar while being rotated about its longitudinal axis and micro-finished by said abrasive.

* * * * *